United States Patent [19]

Yasuda

[11] Patent Number: 4,798,552

[45] Date of Patent: Jan. 17, 1989

[54] APPARATUS FOR PRODUCING PICTURE TUBE

[75] Inventor: Koichi Yasuda, Yotsukaido, Japan

[73] Assignee: Hitachi, Ltd., Tokyo, Japan

[21] Appl. No.: 17,535

[22] Filed: Feb. 24, 1987

[30] Foreign Application Priority Data

| | | | |
|---|---|---|---|
| Mar. 19, 1986 | [JP] | Japan | 61-59156 |
| Mar. 19, 1986 | [JP] | Japan | 61-59159 |
| Mar. 20, 1986 | [JP] | Japan | 61-60535 |
| Mar. 20, 1986 | [JP] | Japan | 61-60537 |

[51] Int. Cl.[4] ..... H01J 9/18; H01J 9/42

[52] U.S. Cl. ..... 445/64; 445/67

[58] Field of Search ..... 445/4, 64, 34, 67

[56] References Cited

U.S. PATENT DOCUMENTS

| | | | |
|---|---|---|---|
| 3,962,764 | 6/1976 | Stewart et al. | 445/45 X |
| 3,962,765 | 6/1976 | Stewart et al. | 445/45 X |
| 4,148,117 | 4/1979 | Bracke et al. | 445/4 |
| 4,445,874 | 5/1984 | D'Augustine et al. | 445/67 X |
| 4,559,019 | 12/1985 | Fendley et al. | 445/67 |
| 4,604,071 | 8/1986 | Pons | 445/4 |

FOREIGN PATENT DOCUMENTS

| | | | |
|---|---|---|---|
| 109349 | 8/1980 | Japan | 445/4 |
| 41646 | 4/1981 | Japan | 445/64 |

*Primary Examiner*—Kenneth J. Ramsey

*Attorney, Agent, or Firm*—Antonelli, Terry & Wands

[57] ABSTRACT

When producing a picture tube, the reference axis of a phosphor screen in the horizontal direction and an in-line horizontal axis of the aperture center of an in-line type electron gun can be aligned highly accurately during a sealing work and picture tubes providing high quality can be obtained with high productivity by use of an apparatus for producing a picture tube which comprises (i) first detection means for detecting a predetermined axis, such as a horizontal axis, of the phosphor screen inside a glass bulb fitted to a bulb holder, (ii) second detection means for detecting a second predetermined axis, such as an in-line horizontal axis of the aperture center, of an in-line type electron gun fitted to a stem mounted on a mount pin, corresponding to the predetermined axis of said phosphor screen;

(iii) a calculation circuit for calculating the detection signal by the first detection means and the detection signal by the second detection means and outputting a "same" or "not same" signal;

(iv) a sealing machine for sealing the glass neck portion to the stem having mounted thereto the electron gun in accordance with the "same" signal; and (v) a driving unit for relatively rotating the bulb holder or the mount pin in accordance with the "not same" signal.

4 Claims, 16 Drawing Sheets

APPARATUS FOR PRODUCING PICTURE TUBE

BACKGROUND OF THE INVENTION

This invention relates to an apparatus for producing a picture tube which apparatus accurately measures and sets the position of an electron gun to the phosphor screen of a picture tube and seals the electron gun at a predetermined position.

In the usual production process of color picture tubes, a stem having an electron gun mounted thereto is sealed to the open end of a neck portion of a glass bulb after the phosphor screen, a graphite electrode, and the like, are formed inside the glass bulb and a shadow mask is fitted. In this case, it is necessary to bring the direction of the horizontal axis on the phosphor screen into conformity with the horizontal axis of an aperture center of an in-line type electron gun.

The production method of the type described above is carried out in the following way. As can be seen from FIGS. 8*a* and 8*b* which are plan views showing the relation of position between the glass bulb and the electron gun, the phosphor screen 1*b* and a graphite electrode (not shown) are formed on the inner surface of a panel 1*a* of the glass bulb 1 and a shadow mask or the like is fitted to the glass bulb 1. Then, the outer periphery of the panel 1*a* of the glass bulb 1 is brought into contact with panel stoppers 3*a*, 3*b*, 3*c* of a later-appearing bulb holder, not shown, as the reference, and the rotation angle $\theta$ between the standard axis $X_1$–$X_2$ in the horizontal direction of the phosphor screen 1*b* determined from the panel stoppers 3*a*, 3*b*, 3*c* and the horizontal direction of the in-line gun $M_1$–$M_2$ of the aperture centers $\mathbf{10}_1$, $\mathbf{10}_2$, $\mathbf{10}_3$ corresponding to the blue (B), green (G) and red (R) of the electron gun disposed in such a manner as to face the phosphor screen 1*b* is detected. Thereafter, the electron gun is sealed into the glass bulb after the rotation angle $\theta$ described above is adjusted to substantially zero. Such a method is disclosed, for example, in Japanese Patent Laid-Open No. 97368/1976.

In accordance with the production method described above, the standard axis $X_1$–$X_2$ of the phosphor screen 1*b* in the horizontal direction is detected using the outer periphery of the glass panel 1*a* as the reference. Since the dimension of the outer surface of this glass panel $\mathbf{1}_a$ has certain allowance for the material and production, the rotation angle $\theta$ is up to about $\pm 0.5°$. On the other hand, color picture tubes (CRTs) ,color display tubes (CDTs) and particularly high resolution CDTs of the recent types require a severer rotation angle $\theta$ of within $\pm 0.3°$, for example, but it is not easy to satisfy such a requirement. Relatively large misconvergence always occurs on both ends of the picture screen and invites the drop of the picture quality. In addition, the number of steps for adjustment becomes greater and productivity drops as much.

SUMMARY OF THE INVENTION

It is therefore an object of the present invention to provide an apparatus for producing a picture tube which apparatus can accurately bring the standard axis of the phosphor screen in the horizontal direction into agreement with the in-line horizontal axis of the aperture centers of the electron gun in a sealing process and can produce a picture tube providing a high quality picture with a high level of productivity.

The object of the invention described above can be accomplished by an apparatus for producing a picture tube which comprises bulb holding means for rotatably holding in a circumferential direction a glass bulb having fitted to the inner surface thereof at least a phosphor screen and a shadow mask, first detection means for detecting the horizontal axis of the phosphor screen inside the glass bulb, a mount pin to which an electron gun mounted to a stem on the same axis as the glass bulb is mounted in such a manner as to be driven both vertically and circumferentially, second means for detecting an in-line horizontal axis of the aperture center of the electron gun, calculation means for outputting a "same" or "not same" signal by calculating the detection signal by the first detection means and the detection signal by the second detection means, and a sealing machine for sealing a glass bulb neck portion to the stem in accordance with the "same" signal.

The horizontal axis of the phosphor screen and the in-line horizontal axis of the electron gun may be replaced by other predetermined axis of the phosphor screen and by other predetermined axis of the electron gun corresponding to the other predetermined axis of the phosphor screen, respectively.

This apparatus further comprises a driving unit which, when the "not same" signal is outputted as a result of calculation of the detection signal by the first detection means and the detection signal by the second detection means, rotates relatively the bulb holder and/or the mount pin until the calculation output signal becomes the "same" signal.

In the apparatus for producing a picture tube in accordance with the present invention having the construction described above, the rotation angle between the predetermined axis of the phosphor screen that is directly measured, such as a reference axis in the horizontal direction, and the predetermined axis of the electron gun corresponding to the former, such as the in-line horizontal axis of the in-line type electron gun, can be controlled, and both axes can be brought into conformity highly accurately. Accordingly, there can be produced easily those picture tubes which provide a high quality picture image.

DESCRIPTION OF THE PREFERRED EMBODIMENTS

Hereinafter, some preferred embodiments of the invention will be described with reference to the accompanying drawings.

Embodiment 1

Figure 1:
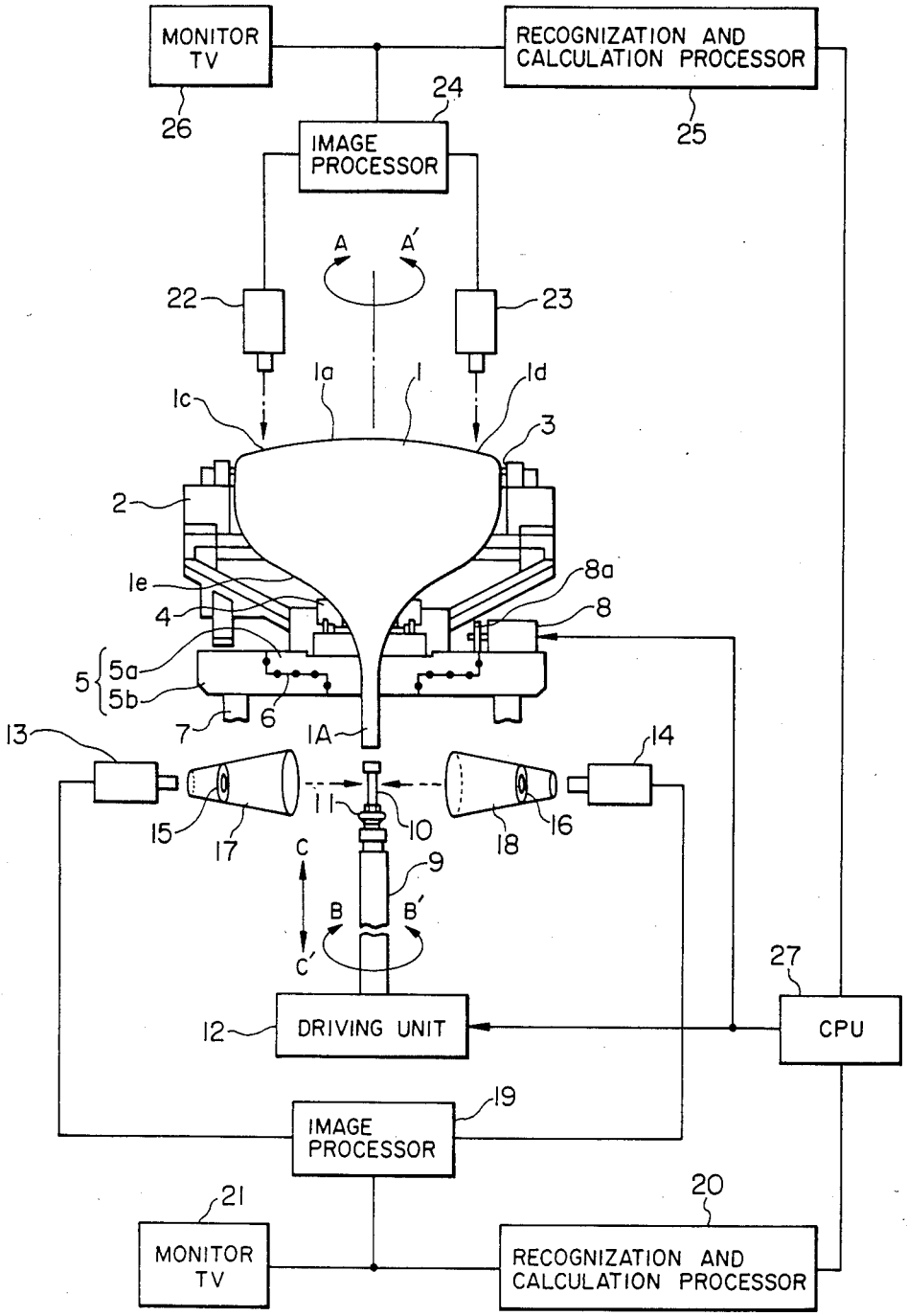
FIG. 1 is a structural view of a picture tube producing apparatus in accordance with one embodiment of the present invention.
Figure 2:
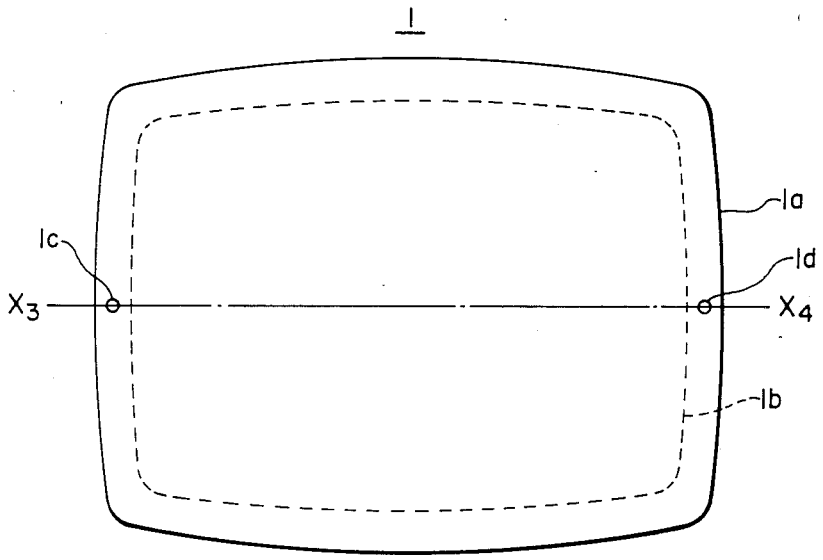
FIG. 2 is a plan view showing the panel of the picture tube.

FIG. 1 is a structural view showing a picture tube production apparatus in accordance with one embodiment of the present invention and partly contains a block diagram. In the drawing, reference numeral 1 denotes a glass bulb into which a phosphor screen, a graphite electrode, a shadow mask, and the like, are fitted. Two identification dots 1*c*, 1*d* which are made of a phosphor, set from shadow mask holes and have a diameter of about 800 μm are formed on both sides of the phosphor screen 1*b* inside the panel 1*a* as shown in FIG. 2, and an imaginary line connecting these identification dots 1*c*, 1*d* forms the horizontal axis $X_3$–$X_4$ as the reference of the phosphor screen 1*b* in the horizontal direction. Therefore, this horizontal axis $X_3$–$X_4$ is not in agreement with the reference line which is set from the outer shape of the panel 1*a* from time to time. Reference numeral 2 denotes a bulb holder which supports the glass bulb 1, and the outer peripheral surface of the panel 1*a* of the glass bulb 1 is supported by this bulb holder 2 through panel stoppers 3.

Reference numeral 4 denotes a saddle for supporting a funnel portion le of the glass bulb 1 and reference numeral 5 denotes a holder receiver for supporting the bulb holder 2 and the saddle 4. The holder receiver 5 incorporates therein a slide portion 6 and first and second holder receivers 5*a* and 5*b* that rotates freely and independently in a direction A–A′ represented by arrow. Reference numeral 7 denotes a support for fixing the second holder receiver 5*b*, and reference numeral 8 denotes driving unit such as a pulse motor which is fixed on the second holder receiver 5*b*. The gears 8*a* of this driving unit 8 mesh with the first holder receiver 5*a* and the first holder receiver 5*a* is rotated in a predetermined pitch in the direction of the arrow A–A′ in accordance with pulse signals inputted to the driving unit 8. Therefore, the glass bulb 1, the bulb holder 2 and the saddle 4 that are mounted to the first holder receiver 5*a* through the slide portion 6 are driven for rotation integrally with one another by the driving unit 8 on the second holder 5*b* fixed on the support 7.

Figure 3:
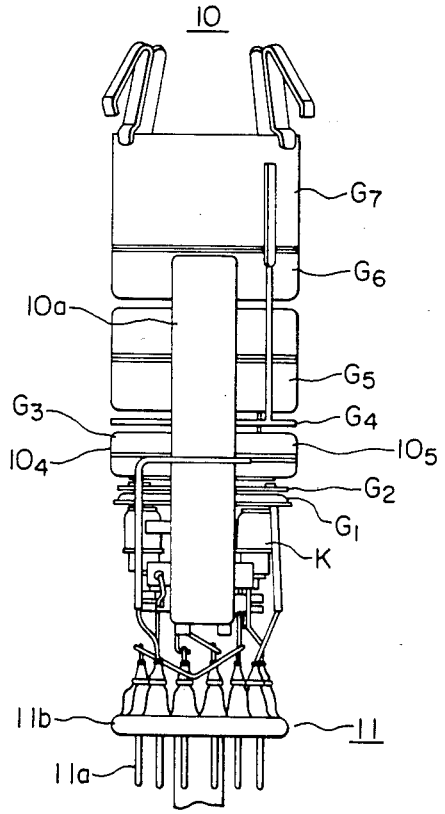
FIG. 3 is a side view of an electron gun of the picture tube.
Figure 4A:
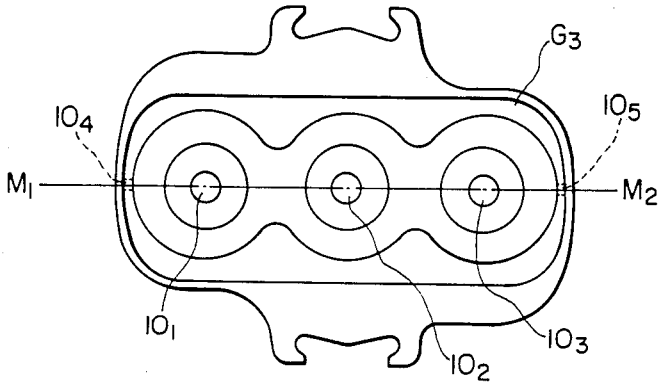
FIG. 4*a* is a plan view showing a third grid of the electron gun.
Figure 4B:
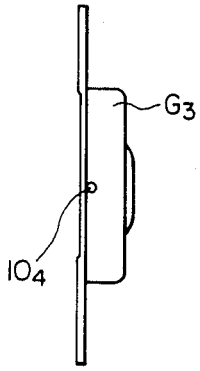
FIG. 4*b* is a side view showing the third grid of the electron gun.

Reference numeral 9 denotes a mount pin to which a stem 11 having mounted thereto an electron gun 10 is fitted and which is disposed on the same axis as the glass bulb 1, and reference numeral 12 denotes a driving means such as a pulse motor which rotates the mount pin 9 in the direction B–B′ and moves it vertically in the direction C–C′. The electron gun 10 used hereby is constituted by stacking sequentially a cathode K, a first grid $G_1$, a second grid $G_2$, a third grid $G_3$, a fourth grid $G_4$, a fifth grid $G_5$, a sixth grid $G_6$ and a seventh grid $G_7$ in a predetermined dimension on a stem glass 11*b*, onto which stem pins 11*a* are implanted, and supporting them by a multiform glass 10*a*, as shown in FIG. 3. Three electron beam apertures $10_1$, $10_2$, $10_3$ corresponding to blue, green and red are arranged in an in-line direction on the third grid $G_3$ as shown in FIGS. 4*a* and 4*b* and round or rectangular reference holes $10_4$, $10_5$ defining the horizontal axis $M_1$–$M_2$ are formed on the third cathode $G_3$, too.

Turning back to FIG. 1, reference numerals 13 and 14 denote first and second industrial television cameras (ITV cameras) that are disposed on the same axis in the direction orthogonal to the mount pin 9 in such a manner as to face each other and to take the images of the reference holes $10_4$, $10_5$ of the third grid $G_3$, respectively. Reference numerals 15 and 16 denote first and second ring-like fluorescent lamps for illumination that are disposed on the same axis with each other in front of the first and second ITV cameras 13 and 14, respectively. Reference numerals 17 and 18 denote first and second hoods for preventing light diffusion that incorporate therein the first and second fluorescent lamps 15, 16 and are disposed on the same axis with each other in front of the first and second ITV cameras 13, 14, respectively, and reference numeral 19 denotes an image processor that measures the absolute positions of the reference holes $10_4$ and $10_5$, taken by the first and second ITV cameras 13, 14, from the reference line on the luster, respectively. Reference numeral 20 denotes a recognization and calculation processor which detects the rotation angle $\theta$ between the horizontal axis $X_3$–$X_4$ of the phosphor screen 1*b* and the horizontal axis $M_1$–$M_2$ of the reference apertures $10_4$, $10_5$ and calculates an angle to be corrected. Reference numeral 21 denotes a monitor television. Reference numerals 22 and 23 denote third and fourth ITV cameras that take the images of the reference point scales 1*c*, $1_d$ (see FIG. 2) formed in the direction of the horizontal axis $X_3$–$X_4$ of the phosphor screen 1*b* on the panel 1*a*, and are disposed to face the glass bulb 1. Reference numeral 24 denotes an image processor that measures the absolute position of the identification dots 1*c*, 1*d*, taken by the third and fourth ITV cameras 22, 23, from the reference line on the raster, and reference numeral 25 denotes a recognization and calculation processor that detects the angle of inclination $\theta$ of the reference axis $M_1$–$M_2$ of the third grid $G_3$ from the horizontal axis $X_3$–$X_4$ of the phosphor screen 1*b* and calculates an angle to be corrected, Reference numeral 26 denotes a monitor television and reference numeral 27 denotes a central processing unit (CPU) that stores the identification dots 1*c*, 1*d*, the shapes of the reference holes $10_4$, $10_5$ of the third grid $G_3$, the horizontal axis $X_3$–$X_4$ of the phosphor screen 1*b*, the horizontal axis $M_1$–$M_2$ of the reference holes $10_4$, $10_5$ and the correction angle for the rotation angles of these axes, and generates instruction to execute the respective control operations to the driving units 8 and 12.

Next, the operation of the picture tube production apparatus having the construction described above will be explained with reference to FIGS. 5 and 6. In these drawings, the drawings on the left side represent flowcharts and those on the right side represent the state at the respective production steps.

Figure 5:
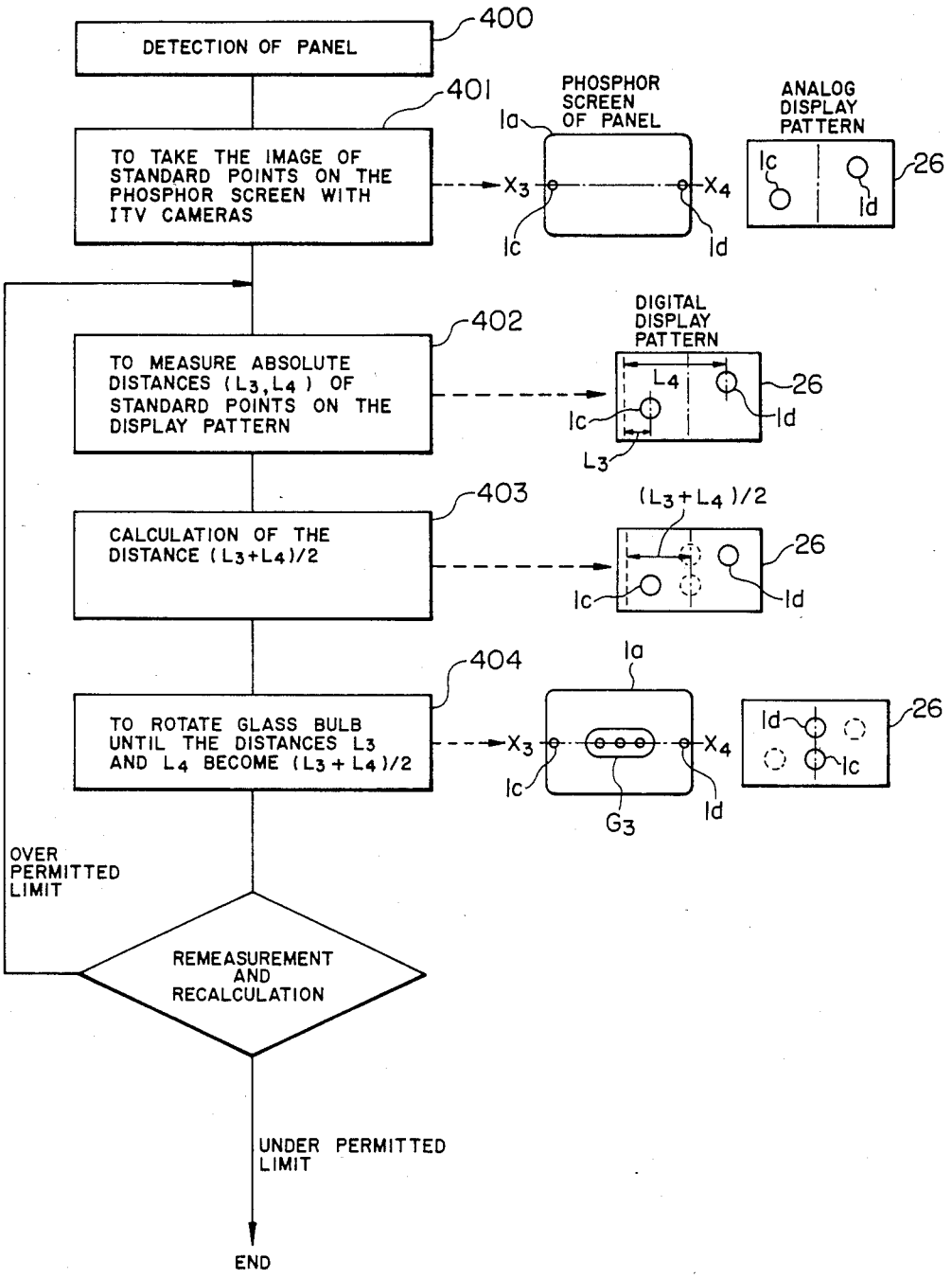
FIG. 5 is an explanatory view showing the steps of detecting the horizontal axis of a bulb.

In FIG. 5, the third and fourth ITV cameras 22 and 23 are operated at step 400 to detect the existence of the panel $1_a$ by their image pick-up operation. If the panel $1_a$ exists, the images of the identification dots 1c, 1d on the panel 1a are taken by the third and fourth ITV cameras 22, 23, and their enlarged image is pattern-displayed on the display surface of the monitor television 26 as a synthetic image of the dots 1c and 1d, at step 401. Next, the image processor 24 measures the absolute positions $L_3$, $L_4$ of the identification dots 1c and 1d from the picture surface reference line on the raster to the center of the enlarged image at step 402. Next, the recognization and calculation processor 25 calculates the distance $(L_3+L_4)/2$ and lets CPU store this value at step 403. Next, the alignment pulse motor of the driving unit 8 is actuated by the instruction signal from CPU 27 at step 404 in order to rotate the glass bulb 1 in the direction A–A' and to make the distance $L_3$ and $L_4$ be equal to the value $(L_3+L_4)/2$. Measurement and calculation are made once again and if the difference between the distance $L_3$, $L_4$ and the value $(L_3+L_4)/2$ is above an allowance limit, the flow returns to the step 402 and if it is below the allowance limit, the flow is complete.

Figure 6:
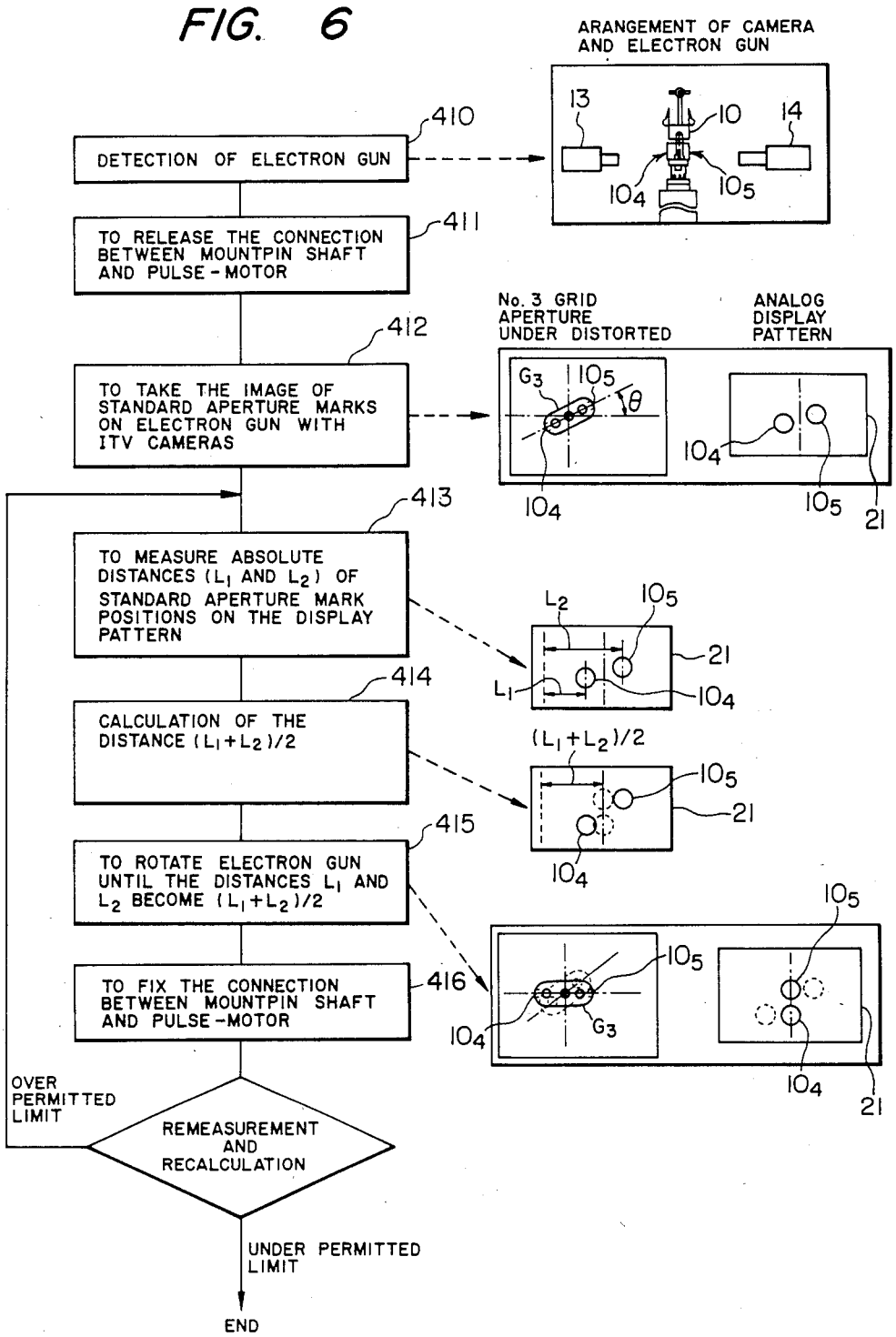
FIG. 6 is an explanatory view showing the steps of detecting the in-line horizontal axis of the electron gun.
Figure 7:
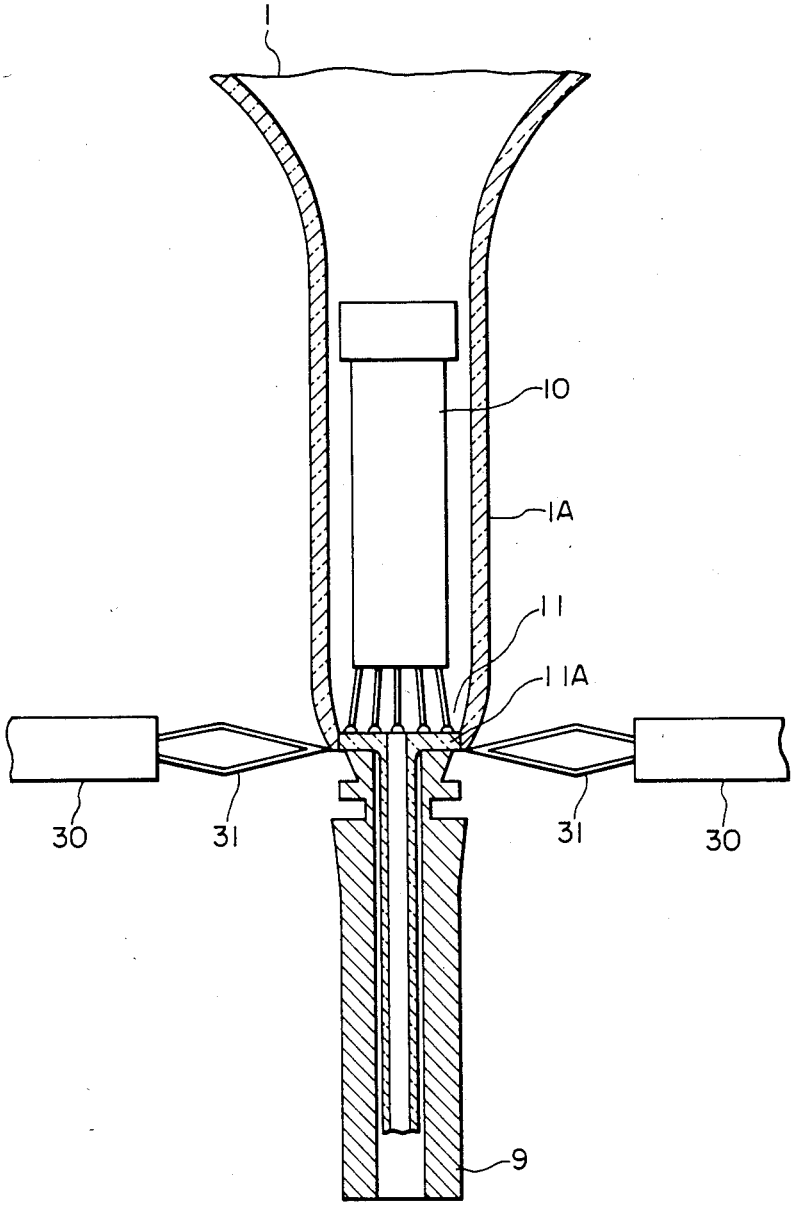
FIG. 7 is a schematic sectional view useful for explaining a sealing method of the picture tube.
Figure 8A:
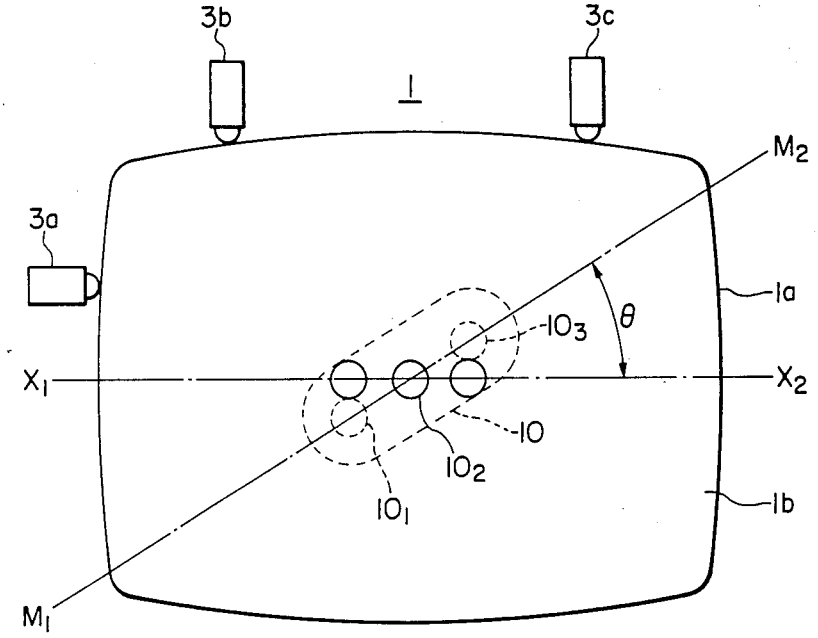
FIGS. 8*a* and 8*b* are schematic plan views useful for explaining the relation of position between a glass panel and the electron gun.
Figure 8B:
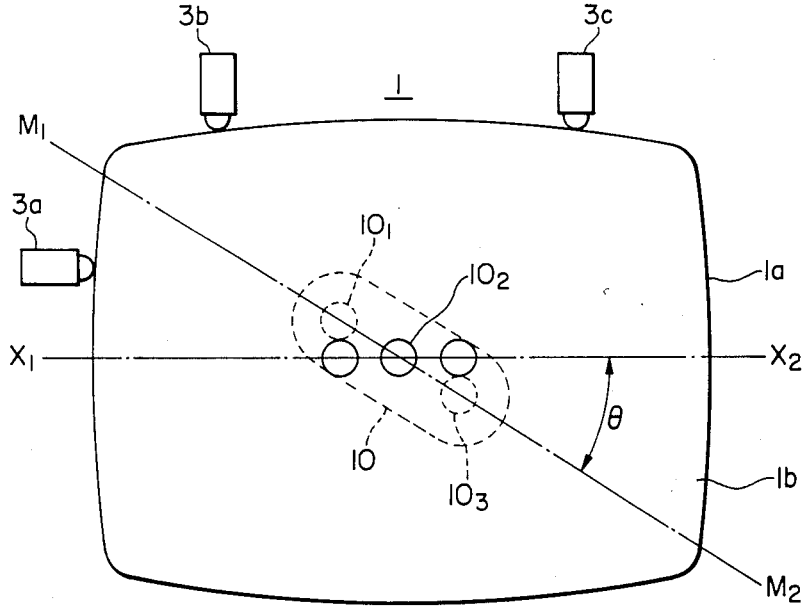

In FIG. 6, on the other hand, the first and second ITV cameras 13 and 14 detect the existence of the electron gun 10 by picking up its image at step 410 and if it does, the clutch of the mount pin 9 interconnected to the driving means 12 is released at step 411. Then, the first and second ITV cameras 13 and 14 pick up the images of the reference holes $10_4$, $10_5$ on both sides of the third grid $G_3$ and the monitor TV 21 displays their enlarged image on the display, respectively, at step 412. Then, the image processor 19 measures the absolute positions $L_1$, $L_2$ from the reference lines displayed on the display to the reference holes $10_4$, $10_5$, respectively, at step 413, and the recognization and calculation processor 20 calculates the distance $(L_1+L_2)/2$ and let CPU 27 store the value, at step 414. The alignment pulse motor of the driving unit 8 is actuated by the instruction signal from CPU 27 at step 415 in order to rotate the first holder receiver 5a in the direction A–A' and to make the distances $L_1$ and $L_2$ be equal to the value $(L_1+L_2)/2$. Measurement and calculation are made once again, and if the difference between the values $L_1$, $L_2$ and the value $(L_1+L_2)/2$ is above the allowance limit, the flow returns to the step 413, and if it is below the allowance limit, the mount pin 9 is fixed to the clutch at step 416. Thereafter, the driving means 12 raises the mount pin 9 in the direction C by a predetermined distance and the neck portion 1A and the stem glass 11A supporting thereon the electron gun 10 are heated and molten by the flame 31 generated from a gas burner 30 of a sealing device to seal them, as shown in FIG. 7.

According to the construction described above, the horizontal axis $X_3$–$X_4$ of the phosphor screen 1b and the horizontal axis $M_1$–$M_2$ of the reference holes $10_4$, $10_5$ of the third grid $G_3$ are brought into highly accurate conformity and their rotation angle becomes substantially zero. Accordingly, the inclination between the horizontal direction of the glass bulb 1 and the in-line horizontal axis of the electron gun 10 can be set highly accurately such as within ±0.3°, and the level of the dynamic convergence characteristics can be improved drastically.

According to the construction described above, the rotation angle between the horizontal direction of the glass bulb 1 and the in-line horizontal direction of the electron gun 1 can be set easily and extremely accurately so that the occurrence of misconvergence can be reduced drastically and the adjustment work by a deflection yoke can be made extremely easily and its work time can be reduced, thereby improving productivity.

In accordance with the method described above, the horizontal axis $X_3$–$X_4$ of the phosphor screen 1b and the in-line horizontal. axis $M_1$–$M_2$ can be brought highly accurately into conformity with each other and after the rotation angle is made substantially zero, the glass bulb 1 and the stem 11 are driven in the axial direction and then subjected to the heating work. For this reason, they can be sealed quite irrelevantly to the rotation of the holder receiver 5 and the set accuracy of rotation that have occurred in the conventional system, and they can be sealed highly accurately and the holder setting adjustment work becomes easier.

Though the embodiment described above illustrates the case where the center axis $M_1$–$M_2$ of the reference holes $10_4$, $10_5$ of the electron gun 10 and the horizontal axis $X_3$–$X_4$ of the phosphor screen 1b are individually arranged to be on the same axis, it is also possible to employ a method which fixes the mount pin 9, and drives then the alignment pulse motor of the driving unit 8 to rotate the first holder receiver 5a in the direction A–A' so that only the side of the glass bulb 1 is rotated, and the same effect as mentioned above can be obtained by a method which fixes the side of the holder receiver 5, and drives then the alignment pulse motor disposed in the driving unit 12 so that 0 the mount pin 9 is rotated in the direction B–B' and the electron gun 10 itself is rotated for arranging them on the same axis.

Though the third grid $G_3$ has the reference holes in the embodiment described, this arrangement is not of course limitative, in particular. Needless to say, the vertical axis may be used in place of the horizontal axis. Furthermore, the present invention can be naturally applied to a delta type electron gun.

In accordance with the present invention described above, the rotation angle between the horizontal axis on the phosphor screen and the horizontal axis of the in-line aperture center of the electron gun can be made substantially zero so that the picture tubes having excellent dynamic convergence characteristics can be produced with high productivity.

In the picture tube production apparatuses described in the following Embodiments 2–4, the portions other than the portion of the sealing machine described above are improved, too, and the portions which bring the horizontal axis of the phosphor screen into conformity with the horizontal axis of the in-line type electron gun are the same as those of Embodiment 1.

First of all, the background relating to the apparatus for producing the picture tube which is in common in Embodiments 2 through 4 will be described.

Embodiments 2 through 4 relate to a sealing machine of the picture tube for sealing the glass bulb having formed therein the phosphor screen and the stem having mounted thereto the electron gun.

In the production process of color picture tubes in general, after the phosphor screen, the graphite electrode, the shadow mask, and the like, are mounted into the glass bulb, the stem having mounted thereto the electron gun is sealed to the open end of the neck portion of the glass bulb. Such sealing technique is disclosed, for example, in Japanese Patent Publication No. 31595/1978. The following sealing machine for the picture tube is used to seal the picture tube described above.

Figure 9:
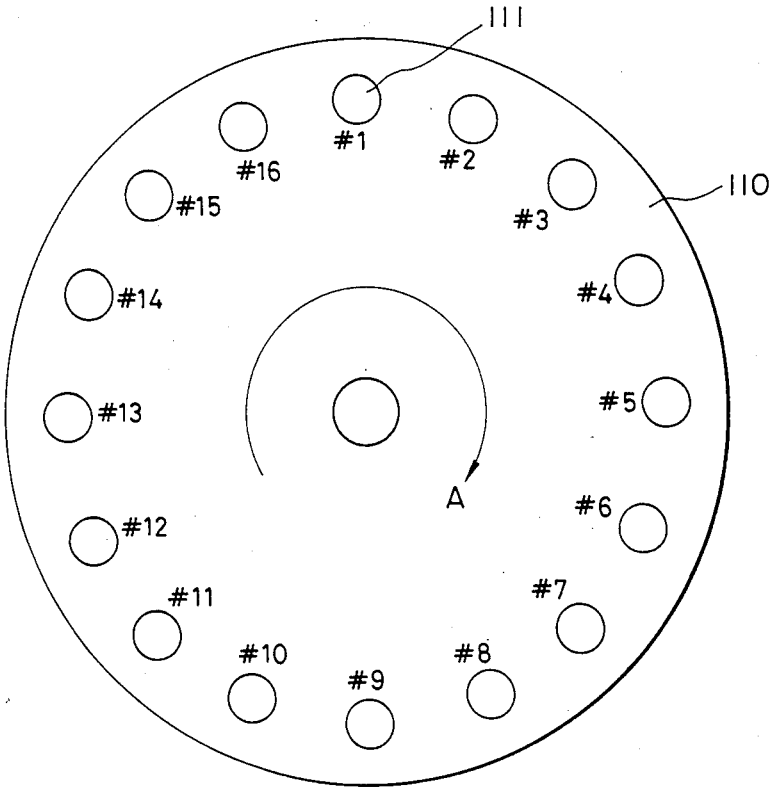
FIG. 9 PRIOR ART
FIG. 9 is a plan view showing a sealing machine for the picture tube.

FIG. 9 is a structural plan view showing the principal portion of a typical conventional sealing machine for the picture tube. In the drawing, a large number of bulb holders 111 for holding the glass bulb with the axis of the tube being the center are disposed regularly and equidistantly around the outer periphery of a disc-like turn table 110, and each of these bulb holders 111 is rotated together with the turn table 110 at a predetermined rate and a predetermined pitch by an automatic driving unit, not shown, in the direction represented by arrow A. In other words, these bulb holders 111 are accurately moved to predetermined positions in a predetermined period by an index driving unit not shown in the drawing. Among the bulb holders 111 on the turn table 110, the bulb holders #1 and #2 in FIG. 9 are generally at the fitting and removing positions of the glass bulb, and the bulb neck portion and the seal portion are pre-heated at positions #3~#8. The bulb neck portion is molten at #9, cut at #10, and cooled slowly at #11~#15. The neck tube (which is generally called "cullet glass") separated from the bulb neck portion by melting is removed at #16.

Figure 10:
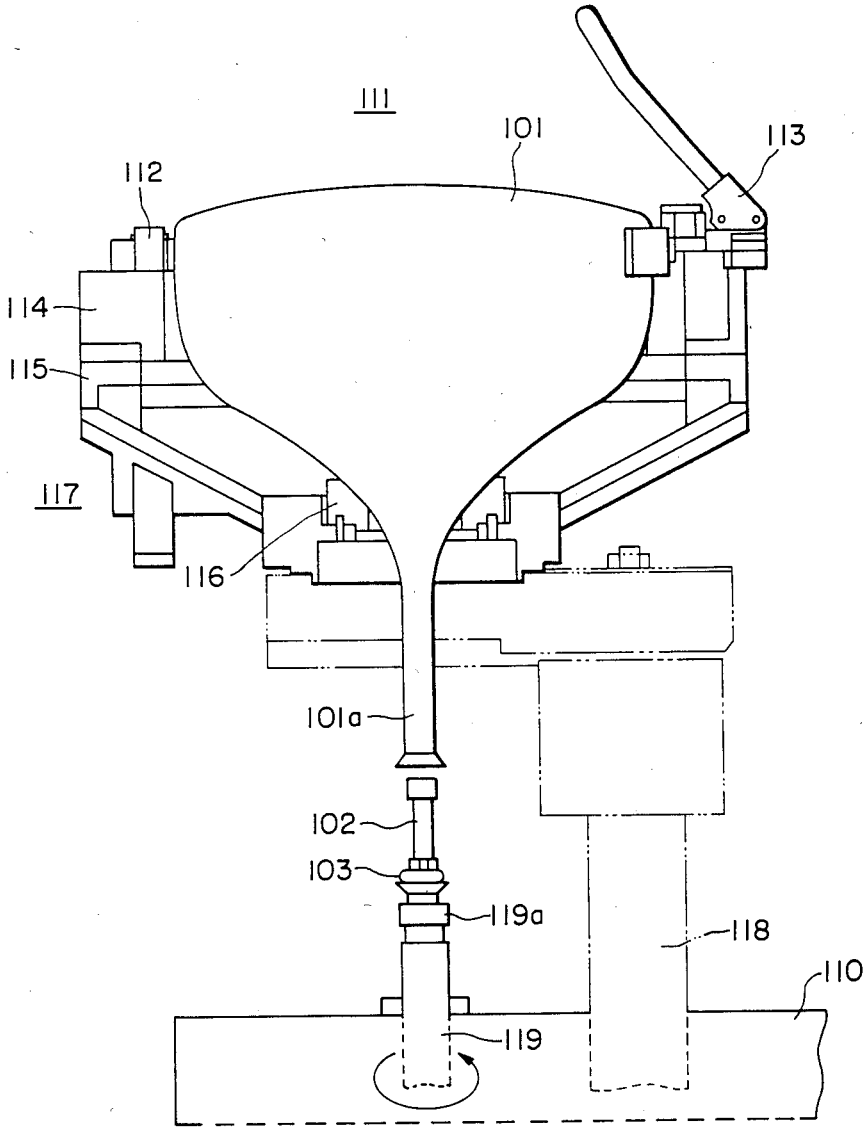
FIG. 10 PRIOR ART
FIG. 10 is a side view of a bulb holder.

FIG. 10 is a sectional view showing the principal portions of the known bulb holder 11 explained with reference to FIG. 9. In FIG. 10, in the bulb holder 111 shown in the drawing, the bulb stopper 112, the panel chuck 113, the bulb support 114, the holder frame 115 and the bulb supporter 116 constitute the bulb holder unit 117 and this unit 117 in turn holds and fixes the glass bulb $10_1$, having formed therein the phosphor screen, the graphite electrode and the shadow mask, at a predetermined reference point. The bulb holder unit 117 is supported and fixed by the support 118 on the turn table 110. Below the bulb holder unit 117 is disposed a mount pin 119 to which the stem 103 having mounted thereto the electron gun is fitted and which rotates and drives vertically the stem in the vertical direction with its axis being the center.

Figure 11:
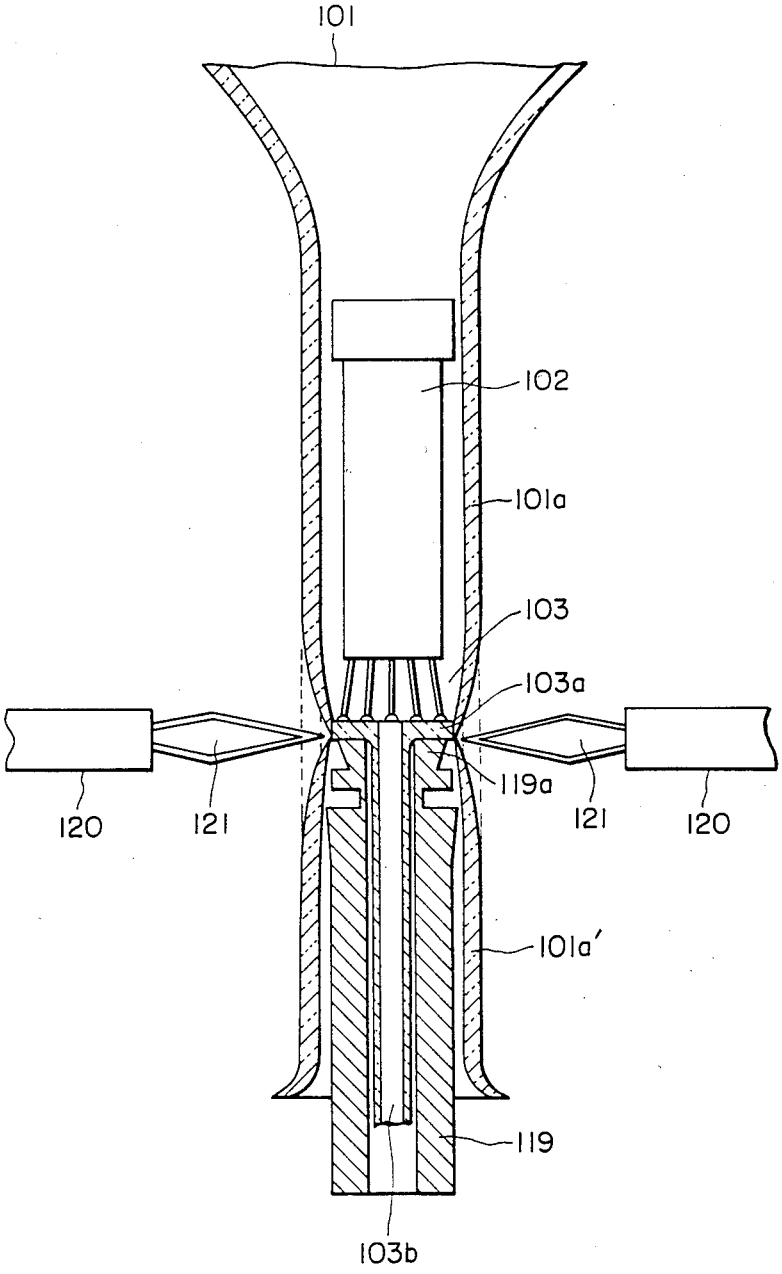
FIG. 11 PRIOR ART
FIG. 11 is a schematic sectional view useful for explaining the sealed state of the picture tube.
Figure 12:
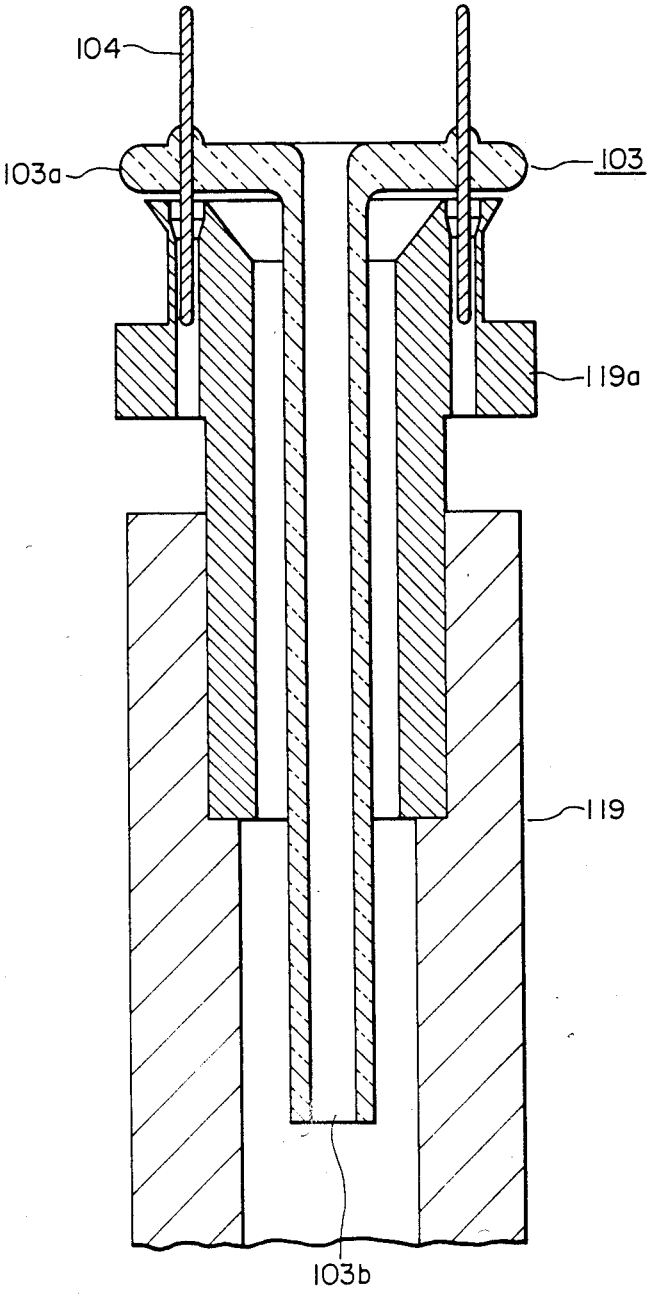
FIG. 12 PRIOR ART
FIG. 12 is a schematic sectional view showing the state where a stem is fitted to a mount pin in a prior art.

In the construction described above, the stem 103 having mounted thereto the electron gun 102 is fitted to the mount pin 119 after rough adjustment, moved up and inserted into the bulb neck portion 101*a*. Then, the electron gun 102 is located to a predetermined level of height by finely adjusting the mount pin 119 in both the rotating direction and the vertical direction. Next, the outer peripheral surface of the neck portion corresponding to the stem glass 103*a* of the stem 103 and the stem glass 103*a* are heated and welded to each other by the flame 121 generated from the gas burner 120 as shown in FIG. 11, and the cullet glass 101*a*′ suspending downward from this weld portion is molten to separate therefrom. In this case, the fused and separated cullet glass 101*a*′ remains on the mount pin base 119*a*. Reference numeral 103*b* denotes an exhaust pipe.

Embodiment 2

In the sealing machine described above, when the stem 103 having mounted the electron gun 102 is sealed to the bulb neck portion 101*a*, the stem 103 is fitted to the mount pin base 119*a* with its plurality of outer pins 104 and the outer peripheral surface of the stem 103*a* being the reference, and the exhaust pipe 103*b* is not particularly fixed. Therefore, if any delicate mechanical vibration is imparted to the electron gun 102 mounted to the stem 103 before or after it is inserted into the bulb neck portion 101*a*, the electron gun 102 is likely to incline back and forth and right and left. If it floats upward during the seal work, the stem 103 is likely to come off from the mount pin base 119*a*. As a result, there is a problem that the seal length of the predetermined length changes so that the convergence characteristics drop and the image quality drops, too.

This embodiment uses a sealing machine of a picture tube in the picture tube production apparatus described in Embodiment 1 which sealing machine can reduce any displacement of the electron gun such as inclination and float during the sealing work, can provide the full seal length with a high level of accuracy and can prevent the drop of the convergence characteristics.

The sealing machine used in this embodiment includes at least a bulb holder for holding the glass bulb at the center of the tube axis, a mount pin for mounting the stem having mounted at the upper part thereof the electron gun and at the lower part thereof the exhaust tube, and a heater for melting and sealing the stem and the glass bulb, wherein the mount pin is equipped with support means for supporting and fixing the exhaust tube of the stem.

Since the support means supports and fixes the exhaust tube during the sealing work, the movement of the stem can be restricted and the displacement of the electron gun can be reduced.

Hereinafter, this embodiment will be described in further detail with reference to the drawings.

Figure 13:
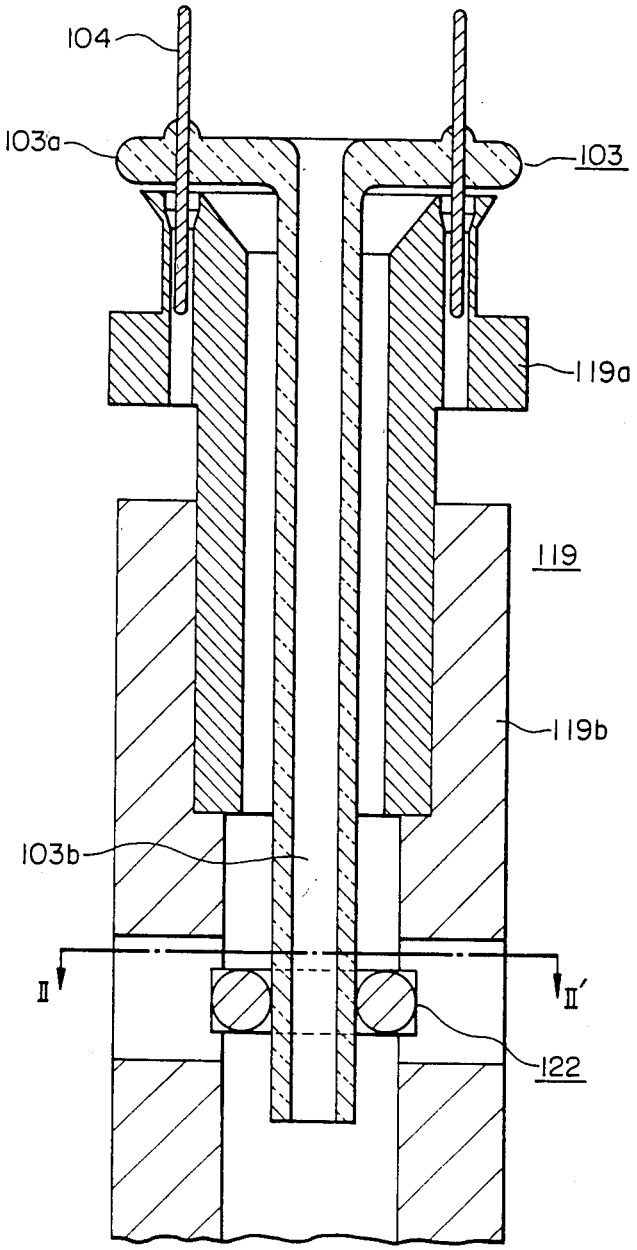
FIG. 13 is a schematic sectional view showing the mount pin in the sealing machine of the picture tube in accordance with another embodiment of the invention.
Figure 14:
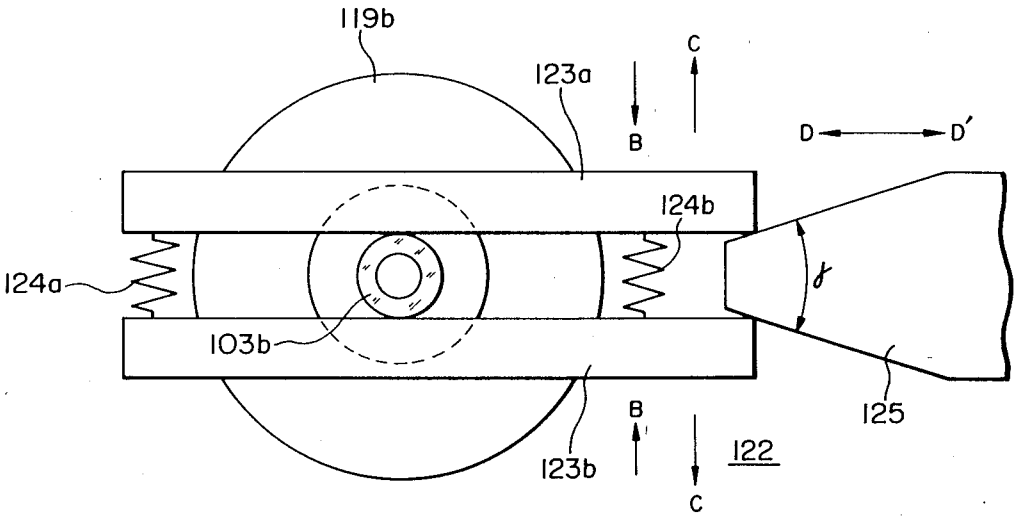
FIG. 14 is a schematic plan view of a support in still another embodiment of the invention.

FIG. 13 is a schematic sectional views of the mount pin for explaining the picture tube sealing machine used in this embodiment, and like reference numerals are used to identify like constituents as in the foregoing drawings. In the drawing, the mount pin 119 consists of a hollow mount pin base 119*a* into which the outer pins $10_4$ of the stem 103 and the exhaust tube 103*b* are inserted with the outer surface of the stem glass 103*a* being in contact with the mount pin base 119*a*, and a hollow mount pin shaft 119*b* into which the mount pin base 119*a* is fitted to obtain the predetermined height. The mount pin 119 is interconnected to a driving unit, not shown, and is rotated and moved vertically during the sealing work. The support 122 is disposed in this mount pin shaft 119*b* of the mount pin 119, and supports and fixes the stem 103 fitted thereto and clamps the exhaust tube 103*b* of the stem 103 at the predetermined penetration position. In this support 122, a pair of metal rods 123*a*, 123*b* are disposed in parallel with each other and two springs 124*a*, 124*b* are fitted and fixed at both ends of these rods in such a fashion that the force of the springs 124*a*, 124*b* pull each other in the direction B while facing each other, as shown in the plan view of FIG. 14.

A trapezoidal wedge 125 is disposed at one of the end portions of the pair of metal rods 123*a*, 123*b* in such a manner as to open the metal rods 123*a*, 123*b* in the direction C and to close them in the direction B while they face each other. This wedge 125 is interconnected to an air cylinder, not shown, and is driven in the direction D–D′ by the reciprocation of the air cylinder, thereby closing and opening the pair of metal rods 123*a* and 123*b*.

The metal rods 123*a*, 123*b* in this embodiment are stainless steel rods having a diameter of 8 mm and a length of 60 mm, and the trapezoidal wedge 125 is made of a stainless steel and its angle $\gamma$ is 45°. The springs 124*a*, 124*b* are tension springs having a wire diameter of 1.0 mm, an outer diameter of 8 mm and the number of windings of 8, and their spring tension is about 2 Kg.

In the construction described above, when the stem 103 is sealed to the glass bulb not shown and when the stem 103 having mounted thereto the electron gun 102 is mounted to the mount pin 119, the wedge 125 is driven in the direction D so as to open the pair of metal rods 123*a*, 123*b* in the direction C. Then, the stem 103 having mounted thereto the electron gun 102 is inserted into the mount pin 119 and the outer pins $10_4$ are inserted into the mount pin base 119, thereby setting the electron gun 102 in a predetermined direction, at a predetermined angle and a predetermined height. Next, the wedge 125 is driven in the direction D' to close the pair of metal rods 123*a*, 123*b* in the direction B so that the exhaust tube 103*b* of the stem 103 is clamped, supported and fixed between the pair of metal rods 123*a* and 123*b*. Thereafter, the mount pin 119 is raised and inserted into the bulb neck portion 101*a* as shown in FIG. 10 and located at a predetermined height, ad the bulb neck portion 101*b* is then heated and sealed by the flame 121 of the gas burner 120.

According to the construction described above, the exhaust tube 103*b* of the stem 103 is clamped between the pair of metal rods 123*a* and 123*b* of the support 122 during sealing, and any displacement of the electron gun does not occur before, after and during the sealing work and a predetermined seal length can be fully secured.

In this embodiment, the portions other than the means for supporting and fixing the exhaust tube are the same as those of Embodiment 1.

As described above, since the support means for supporting and fixing the exhaust tube is disposed on the mount pin, the displacement of the electron gun during the sealing work can be mitigated and the seal length and the seal angle can be secured highly accurately. Therefore, this embodiment provides the picture tube having the excellent convergence characteristics in addition to the effects brought forth by the first embodiment.

Embodiment 3

In the afore-mentioned conventional sealing machine, the stem 103 having mounted thereto the electron gun 102 is sealed to the bulb neck portion 101*a* in the following manner.

Figure 15:
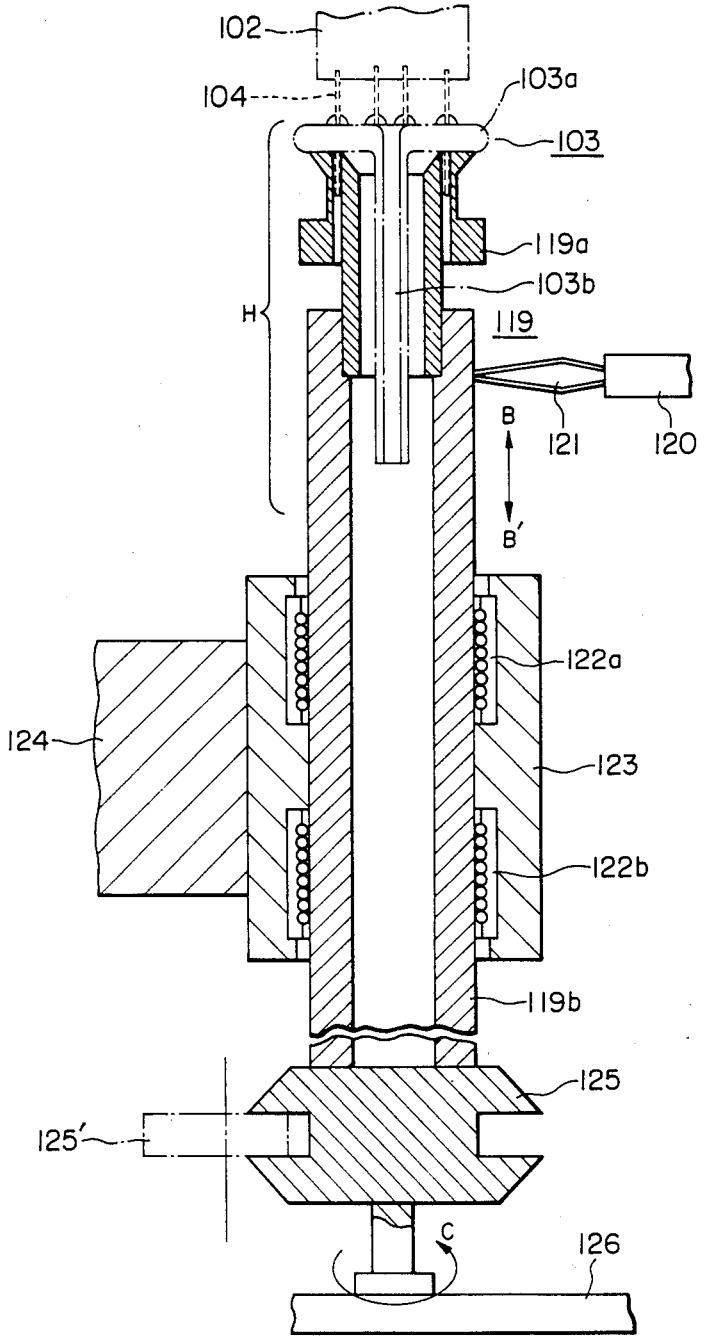
FIG. 15 PRIOR ART
FIG. 15 is a sectional view showing the principal portions of a conventional mount pin.

First of all, the stem 103 having the electron gun 102 is fitted onto the mount pin base 119*a* of the mount pin 119 and is inserted into the bulb neck portion 101*a* that is fixedly arranged. Next, the electron gun 102 is located to the predetermined direction and height, and for this step, a bearing main body 123 equipped with first and second ball bushes 122*a* and 122*b* is disposed on the outer peripheral surface of the mount pin shaft 119*b* as shown in FIG. 15 and is interconnected to a head arm 124 which is in turn connected directly to the turn table, in order to drive the mount pin 119 in the vertical direction (the direction B–B') and in the rotating direction (the direction C). Incidentally, reference numeral 125 denotes a gear for rotating the mount pin 119 and reference numeral 125' denotes a driving gear that meshes with the gear 125 and transmits the rotation driving force to the gear 125. Reference numeral 126 denotes a rail for moving the mount pin 119 in the vertical direction. When the mount pin 119 moves on the rail 126 having a certain gradient, it moves in the vertical direction. In this case, the first ball bush 122*a* of the bearing main body 123 is positioned in the proximity of the heating portion H heated by the flame 121 of the gas burner 120, and is therefore provided with clearance in consideration of thermal expansion of the mount pin 119 when it is driven in the vertical direction. As a result, the position accuracy of the mount pin 119 drops and accurate location of the electron gun in the direction and the height becomes impossible so that the convergence characteristics drop and the quality of picture drops, too.

In the picture tube production apparatus described in Embodiment 1, this embodiment uses a sealing machine which can improve the position accuracy of the mount pin, can locate the electron gun highly accurately and can prevent the drop of the convergence characteristics.

The sealing machine used in this embodiment includes at least a bulb holder unit for holding the glass bulb at the center of the tube axis, a mount pin to which the stem, having mounted at the upper part thereof the electron gun and at the lower part thereof the exhaust tube, is mounted, and a heater for melting and sealing the stem and the glass bulb, wherein the mount pin includes a first bearing structure for driving the mount pin in the rotating direction and a second bearing structure for driving the mount pin in the vertical direction.

Since the sealing machine used in this embodiment has the construction described above, the functions of the mount pin are divided into the rotating operation and the vertical motion, the clearance of the mount pin can be reduced.

Hereinafter, this embodiment will be described in further detail with reference to the drawing.

Figure 16:
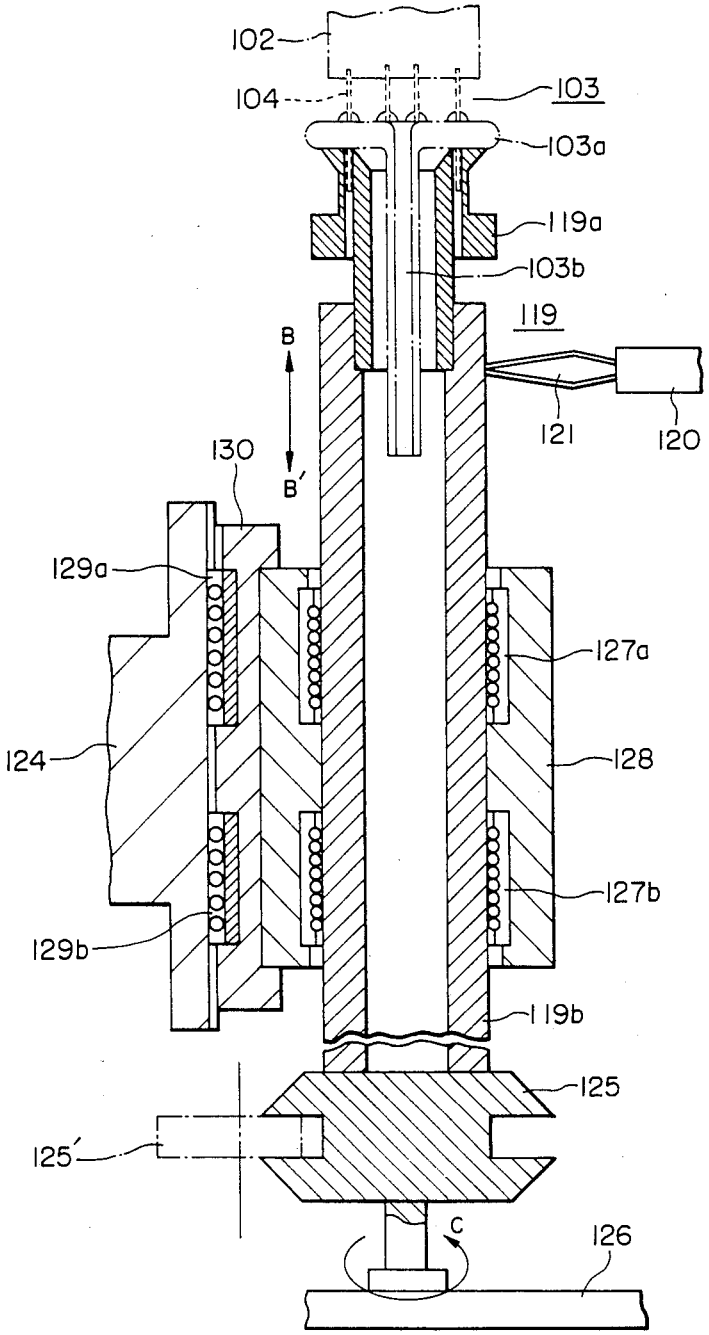
FIG. 16 is a sectional view showing the principal portions of the mount pin in still another embodiment of the present invention.

FIG. 16 is a sectional view showing the principal portions of the mount pin and is useful for explaining the sealing machine of the picture tube used in this embodiment. In the drawing, like reference numerals are used to identify like constituent elements as in the foregoing drawings.

In the drawing, the mount pin 119 consists of hollow mount pin base 119*a*, into which the outer pins 104 of the stem 103 and the exhaust tube 103*b* are inserted and fitted with the outer surface of the stem glass being in contact with the mount pin base, and the hollow mount pin shaft 119*b* into which the mount pin base 119*a* is fitted in such a manner as to obtain a predetermined height. The gear 125 is directly connected to the lower part of the mount pin 119, which is positioned on the rail 126. A first bearing structure 128 having first and second bearings 127*a* and 127*b* are disposed on the outer peripheral surface of the mount pin shaft 119*b* of the mount pin 119 in order to rotate the mount pin 119 only in the rotating direction (the direction C), and a second bearing structure 130 having first and second thrust bearings 129*a* and 129*b* for driving the mount pin 119 in only the vertical direction (the direction B–B') with respect to the fixed head arm 124 is fixedly disposed on the first bearing structure 128.

The material and dimention of each constituent component of the second bearing 130 may be determined in consideration of the first bearing which is known in the art.

According to the construction described above, the mount pin 119 is driven in the rotating direction by the first bearing structure 128 and in the vertical direction by the second bearing structure 130 and its function is thus divided into two parts. Therefore, the clearance of the mount pin 119 can be reduced and its position accuracy can be improved with the result such that the alignment work of the electron gun 102 becomes easier.

In the embodiment described above, the portions other than the bearings are the same as those of Embodiment 1.

Since the first bearing structure for rotating the mount pin and the second bearing structure for moving the mount pin in the vertical direction are disposed on the mount pin in the embodiment described above, the function of the mount pin is divided into two functions and the clearance of the mount pin can be reduced. Accordingly, this embodiment can improve the position accuracy of the electron gun, the convergence characteristics and the picture quality in addition to the effects brought forth by Embodiment 1.

Embodiment 4

In the afore-mentioned conventional sealing machine, the temperature of the flame 121 of the gas burner 120 is about 1,200° C. when heating the bulb neck portion 101*a* by the gas burner 120, and the flame temperature is changed in order to effect sealing through various heating steps such as preheating over several stages, melting, cutting, annealing, and the like so that the heating temperature fluctuates greatly from the standard. Namely, though the preheating temperature may be up to 400° C., the temperature of the flame 121 is remarkably higher than this temperature and the difference between the flame temperature and the pre-heating temperature is so great that the pre-heating temperature is obtained by adding the environmental air to the flame. In accordance with this method, however, the change of the heating temperature from the standard is great due to external disturbance. If the heating temperature changes to the high temperature side in the preheating step, the inner lead 102*a* of the electron gun 102 shown in FIG. 11 is oxidized excessively and if it changes to the low temperature side, cracks occur due to thermal strain of the bulb neck portion 101*a*. In either case, the quality and yield of the picture tube drop. This problem becomes particularly critical when those methods are used for sealing the so-called "culletless bulb" in which the cullet glass does not occur at the end portion of the bulb neck portion 101*a* after it is welded to the stem 103 and then sealed.

In the picture tube production apparatus described in Embodiment 1, this embodiment uses a sealing machine which can reduce the variance of the heating temperature, and can improve the quality and yield of the picture tube.

The sealing machine used in this embodiment includes at least a bulb holder for holding the glass bulb with the tube axis being center, a mount pin for holding the electron gun mounted to the stem disposed inside the glass bulb neck portion and heater means for heating, melting and sealing the stem and the glass bulb neck portion, wherein the heater means comprises a substantially cylindrical heating chamber, a heater stored in the heating chamber for heating to a predetermined temperature, a temperature controller for controlling the heating temperature of the heater, a high pressure gas inlet for introducing a high pressure gas from outside into the heating chamber and a nozzle for blowing the heated high pressure gas to the glass bulb neck portion.

According to the construction described above, the high pressure gas whose temperature is controlled can be blown to the glass bulb neck portion and can heat it.

Though air is generally used as the gas, it may be an inert gas such as $N_2$ or Ar. If the inert gas is used, it is effective for preventing oxidization.

Hereinafter, this embodiment will be described in further detail with reference to the drawing.

Figure 17:
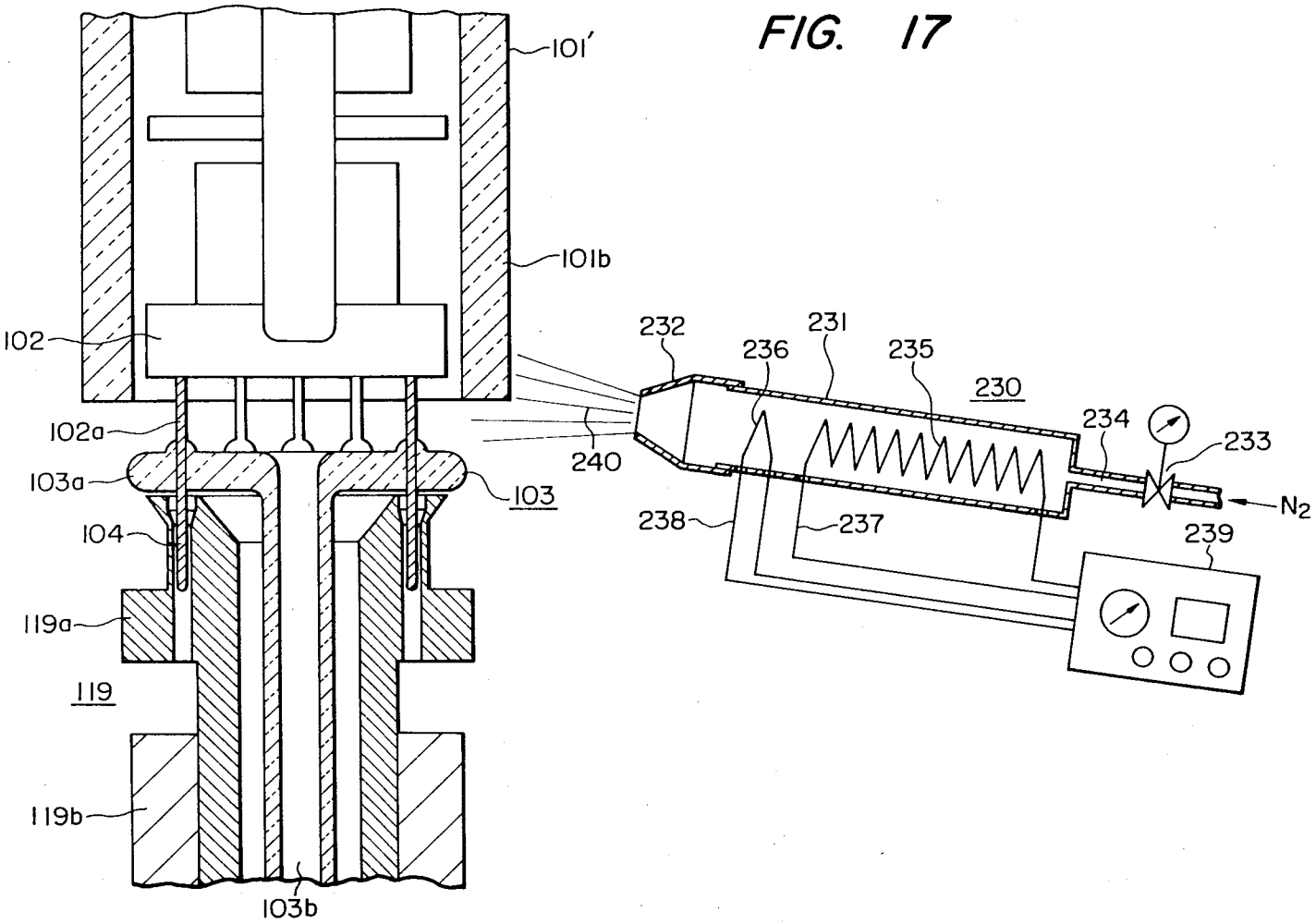
FIG. 17 is a schematic sectional view useful for explaining the sealing machine for the picture tube and its heater in still another embodiment of the invention.

FIG. 17 is a schematic sectional view showing the principal portions of the sealing machine for the picture tube, and like reference numerals are used to identify as in the foregoing drawings. In the drawing, heating means 230 includes a cylindrical heating chamber 231 which is made of a heat resistance metal (e.g. stainless steel) and is 23 mm in diameter and 300 mm long, a nozzle 232 disposed at the tip portion of the heating chamber 231 and a high pressure gas inlet 234 for introducing a high pressure gas such as air from outside through a safety valve 233, at the rear end portion of the heating chamber 231. A heater 235 formed by winding a nichrome wire, for example, in a coil form and a thermo-sensor 236 using a thermo-couple are stored inside the heating chamber 231 on the nozzle 232 side. The heater 235 and the thermo-sensor 236 are connected to a temperature controller 239, which functions also as an external variable voltage power source, through lead wires 237 and 238, respectively. The temperature controller 239 can change the power source voltage applied to the heater 235, and can increase and decrease the heating temperature from about 200°to about 700° C. in the step of about 50° C., for example, and can control the temperature within the error of ±20° C. with respect to a given temperature.

In the heating means 230 described above, the high pressure air is introduced into the heating chamber 231 through the inlet 234 and the power source voltage is supplied from the temperature controller 239 to the heater 235 in order to heat the heater 235. The heated high pressure gas 240 is blown from the nozzle 232 to the neck portion 101*b* of the culletless bulb 101′ to heat the work portion. In this case, since the heating temperatures are different from each other according to the each step of working the culletless bulb neck portion, the necessary temperatures are set to the temperature controller 239, so that the high pressure air 240 whose temperature is controlled by the thermo-sensor 236 and which is heated to the necessary temperature is blown to the bulb neck portion 101*b*.

More definitely, this heater means 230 is disposed at the work position of the bulb neck portion 101*b*, that is, at each position #3~#8 and #11~#15 of each bulb holder 111 in the heating and working step of the bulb neck portion 101*b* on the turn table 110 shown in FIG. 9. At the position #3 of the bulb holder 111, the temperature is about 300° C. while it is about 600° C. at the position #8. In other words, the temperature is raised step-wise at a rate of about 50° to 100° C. so that the bulb neck portion 101*b* is pre-heated gradually from the low temperature to the high temperature with the revolution of the turn table 110. Thus, the occurrence of thermal strain of the bulb neck portion 101*b* can be reduced and the occurrence of glass break can be eliminated. On the other hand, after the bulb neck portion 101*b* is molten and cut by the gas burner, the temperature step is provided so that the temperature is about 600° C. at the position #11 of the bulb holder 111 and about 300° C. at the position #15 at a rate of 50° to 100° C. Accordingly, the seal portion between the stem 103 and the bulb neck portion 101*b* is gradually heated and cooled from the high temperature to the low temperature with the revolution of the turn table 110 so that the thermal strain of the bulb neck portion 101*b* can be absorbed. Therefore, the heating means is effective when used for the preheating and cooling steps of the heating steps, particularly for the pre-heating step.

In the heating means 230 described above, while the stem having mounted thereto the electron gun 102 is inserted into the bulb neck portion 101*b* as shown in FIG. 17, the heated high pressure air 240 is blown from the nozzle 232 and the inner lead 102*a* of the electron gun 102 is heated simultaneously. In this case, however, since the temperature of the high pressure air 240 blown from the nozzle 232 is set within the range of about 600° C. ±20° C., the inner lead 102*a* is heated at 500° to 600° C. which is lower than the oxidation temperature. Accordingly, excessive oxidation of the inner lead 102*a*, which will otherwise result in the critical problem of the culletless bulb, can be prevented reliably.

Incidentally, the embodiment described above uses the gas burner for the bulb holders #9 and #10 corresponding to the melting and cutting of the bulb neck portion because it can easily provide a high temperature, but the heating means 230 for blowing the high pressure gas can also be used for these bulb holders.

In this embodiment, the portions other than the heater means are the same as those of Embodiment 1.

In accordance with the embodiments of the present invention described above, the heater means can control highly accurately the heating temperature at the heatworking step of the bulb neck portion and can reliably prevent the occurrence of excessive oxidation of the inner lead of the electron gun and the occurrence of cracks due to the thermal strain of the bulb neck portion. Accordingly, besides the effects brought forth by Embodiment 1, picture tubes having higher quality and reliability can be obtained, the production yield and hence, productivity, can be improved drastically.

In the foregoing drawings, like reference numerals represent the same or like constituents.

What is claimed is:

1. An apparatus for producing a picture tube comprising:

bulb holding means for rotatably holding in a circumferential direction a glass bulb having at least a phosphor screen on the inner surface thereof and a shadow mask fitted therein;

first detection means for detecting the horizontal axis of said phosphor screen inside said glass bulb;

a mount pin to which an electron gun mounted to a stem on the same axis as said glass bulb is mounted in such a manner as to be driven both vertically and circumferentially;

second detection means for detecting an in-line horizontal axis of the aperture center of said electron gun;

calculation means for outputting a "same" signal or "not same" signal by calculating the detection signal by said first detection means and the detection signal by said second detection means; and a sealing machine for sealing a glass bulb neck portion to said stem in accordance with said "same" signal.

2. The apparatus for producing a picture tube as defined in claim 1 which comprises a driving unit for relatively rotating said bulb holder and/or said mount pin until said "not same signal" becomes said "same" signal when the signal obtained by calculating the detection signal by said first detection means and the detection signal by said second detection means is said "not same" signal.

3. The apparatus for producing a picture tube as defined in claim 2 wherein said first detection means picks up the images of two scales disposed on both end sides of said phosphor screen inside said glass bulb by use of industrial television (ITV) cameras and processes said images.

4. The apparatus for producing a picture tube as defined in claim 1 wherein said first detection means picks up the images of two scales disposed on both end sides of said phosphor screen inside said glass bulb by use of industrial television (ITV) cameras and processes said images.

* * * * *